US005123675A

United States Patent [19]

Staats, III

[11] Patent Number: 5,123,675

[45] Date of Patent: Jun. 23, 1992

[54] CLAMP LOCK BINDING

[76] Inventor: Henry N. Staats, III, 349 Tenney Cir., Chapel Hill, N.C. 27514

[21] Appl. No.: 746,488

[22] Filed: Aug. 16, 1991

Related U.S. Application Data

[63] Continuation-in-part of Ser. No. 666,380, Mar. 8, 1991, abandoned.

[51] Int. Cl.[5] ..... B42D 1/00

[52] U.S. Cl. ..... 281/21.1; 402/68; 412/43

[58] Field of Search ..... 281/21.1; 402/68, 80 R; 412/33, 38, 43; 283/58

[56] References Cited

U.S. PATENT DOCUMENTS

| | | | |
|---|---|---|---|
| Re. 28,202 | 10/1974 | Abildgaard et al. | 281/21 |
| 4,369,013 | 1/1983 | Abildgaard et al. | 412/38 |
| 4,453,851 | 6/1984 | Purcocks | 402/15 |
| 4,620,724 | 11/1986 | Abildgaard et al. | 281/15 |
| 4,625,996 | 12/1986 | Hymmen | 281/21 |
| 4,685,700 | 8/1987 | Abildgaard | 281/21 |

*Primary Examiner*—Timothy V. Eley
*Assistant Examiner*—Willmon Fridie, Jr.
*Attorney, Agent, or Firm*—Olive & Olive

[57] ABSTRACT

A molded plastic binding for positively securing a plurality of sheets of thin material having apertures along one edge, wherein two binding strips are provided, one with projecting fingers which mesh with the apertures of the thin material and apertures of the second binding strip; wherein the linear protrusions on the projecting fingers of the first binding strip lock beneath wedges along elongated holes on the second binding strip so that the sheets are securely fastened together against accidental or deliberate opening. A preferred embodiment incorporates rectangular apertures in the thin material on any multiple of 0.5625 inch centers with the fingers having a cross-section considerably less than the area of the individual apertures of the thin material but with a finger width slightly less than the narrow side of the rectangular aperture.

21 Claims, 4 Drawing Sheets

CLAMP LOCK BINDING

CROSS-REFERENCE TO RELATED APPLICATIONS

This is a continuation-in-part of application Ser. No. 07/666,380 filed Mar. 8, 1991.

The instant invention is also related to pending U.S. application Ser. No. 256,462 filed Oct. 12, 1988, by the same inventor and issued Mar. 5, 1991, as U.S. Pat. No. 4,997,208.

BACKGROUND OF THE INVENTION

1. Field of the Invention

This invention relates to a molded plastic binding for sheets with holes. The holes are preferably of the same size and pattern as those marketed worldwide by General Binding Corporation (GBC) and its competitors for several decades.

2. Description of the Related Art

One common means that has been used to bind variable thicknesses of paper is a two-element metal binder comprising a first linear element, the ends of which extend upward through holes in the material to be bound, through holes in a flat upper second element, and toward each other on the top of the sheets to be bound. Two sliding enclosures hold the ends of the first element to the second element. Such a binding provides an easily releasable binding for adjustment of the number of bound sheets, and rebinding of the new sheets.

Another binding system, GBC binding systems, uses flat, plastic blanks resembling a comb with fingers curled into its binding strip. The bindings are typically used with sheets having 19 holes, each measuring approximately 0.125"×0.300" and located on 0.5625" centers adjacent to one long edge of 8½"×11" paper sheets. Larger sheets with more holes are generally used outside the United States. Users insert the binding into a machine where it is uncoiled slightly so that a stack of sheets bearing holes can be engaged with the comb fingers. When the coiled fingers are restored to their original position, the now bound stack of sheets is free to pivot upon the coiled binding. This book will lie flat and open to a selected page or fold back upon itself for convenient handling. Such bound books can be unbound to add, delete, or change page sequence.

As GBC plastic bindings proliferated throughout the world, the need arose to bind thicker, heavier books with greater security. In the field of binding, the words "secure" and "security" refer to the ability of a binding to hold its contents intact without failure in the ordinary or abnormal use of the bound product. This need for security led to GBC's development of its now-expired patented "SURELOX" binding which employed arrowhead-like tips on two or more fingers that were inserted into notched holes in the binding strip (Lane, U.S. Pat. No. 2,910,068). The disclosure of this patent and all other patents and patent applications cited herein is incorporated herein by reference. Books bound in this manner resist abuse but are time-consuming to assemble. Demands for more security continued and bookbinders began to cement the finger tips of bindings to binding strips to hold them in place. While this process seemed to work well, the adhesives then available embrittled the plastic over time and caused premature failures of bound books.

In the late 1960's the Velo-bind Corporation (Sunnyvale, Calif.) began marketing a binding system having the purpose of binding paper sheets securely. The Velo-bind system, described in Abildgaard (U.S. Pat. No. 3,596,929, Reissue No. 28,202 and others) binds sheets with 0.125" diameter holes on 1" centers adjacent to the long edge of 8½"×11" sheets. Sheets are bound by inserting an eleven-fingered plastic binding strip into coinciding holes of piled sheets. The straight fingers protrude through the stack so that a second, flat binding strip with recessed holes will mate with the protruding fingers. The stack is compressed and the portions of each finger beyond the binding strip are removed by hot-shearing. This smears the near-molten plastic into recessed holes and around the finger stubs thus producing a type of flush rivet.

When books are bound with a Velo-bind binding, they are considered permanently bound since they are not intended to be unbound to delete, add, or change page sequences. If such a book is unbound for any reason, a brand new binding must be used to rebind the book. Books bound with a Velo-bind binding, when opened, do not lie flat and cannot assume a back-to-back mode.

Generally speaking, the marketplace has accepted Velo-bind's bindings despite the fact that the bound books do not lie flat, the covers cannot be put back-to-back, and it is not possible to "unbind" a bound book to delete, add or change page sequences without destruction of the original binding. Velo-bind users also encounter occasional catastrophic failure of their rivet heads when thick, heavy bound books are dropped on the floor, bumped or opened abruptly after prolonged exposure to cold environments. Despite these negative aspects, thin books bound with the Velo-bind system have the appearance and reputation of security.

A number of patents disclose plastic binding strips having longitudinally spaced studs which can be bent over at a 90° angle. For example, the studs of Hymmen (U.S. Pat. No. 4,625,996) are serrated and fit into serrated grooves on a second binding strip. Although such bindings may be used on a variety of thicknesses of bound paper, the discrete nature of the serrations means that for some sizes of bound books, the binding may be too tight or too loose when the serrated strip is hooked into the best-fitting position in the serrated grooves.

The patents of Abildgaard (U.S. Pat. Nos. 4,674,906 and 4,685,700) disclose strips having round studs bendable at 90 degrees into grooves in shaped overhangs in a second strip. The studs are smooth and round and are detachably secured in the grooves, and may possibly be dislodged accidentally by a sharp blow or twisting of the book. They do not have a structural mechanism for securely locking the studs in the overhangs.

Another invention by the inventor herein, described in pending patent application U.S. application Ser. No. 256,462, filed Oct. 12, 1988, issued as U.S. Pat. No. 4,997,208 on Mar. 5, 1991, also discloses a security binder for positively and permanently securing a plurality of sheets. The binding strip elements are provided with lateral projecting members having angled projections permitting entry of the projecting members into spaced apertures but preventing removal from the apertures.

From the foregoing it is clear that there is a need and market for secure binding systems which are held together firmly. It is therefore an object of this invention to provide a binding system which has the ability to lock to hold contents intact. It is a further object of the invention to provide a binding system which may be made to fit standard rectangular-punched (GBC) holes on paper sheets.

Other objects and advantages will be more fully apparent from the following disclosure and appended claims.

SUMMARY OF THE INVENTION

The invention is a new and useful two-piece, molded plastic binding which, in its preferred embodiment, is totally secure in the binding of books of two sheets up to a thickness of approximately ¾" or 200 sheets of 0.0035" thick, 20 lb. office paper. A simple mold change permits the binding of even thicker and heavier books without diminishing the ability of the binding to resist physical abuse or mishandling. Furthermore, books can be bound manually with little more than simple clamps and fixtures, although mechanisms for binding semi-automatically are envisioned.

The new binding of the invention preferably employs only six of the available 19 GBC sized holes which are normally used on one of the 11" sides of standard, 8½" × 11" paper sheets. While the bindings of the invention are also on 9/16" centers, all the holes used for binding are not equally spaced from each other, but are arranged in three pairs of holes which take advantage of the benefits of the instant invention. One of the most important benefits is that the preferred embodiment of the binding can be used on sheets containing either 19 or 6 holes, both perforated with the same GBC-type punching machine. In other words, a user can punch sheets with the GBC-machine with 19 holes and use GBC bindings with 19 fingers or the binding of the invention with only six fingers, or punch only six holes for the preferred binding of the invention. Fewer holes can be punched because with the GBC punching machines one or more punches can be eliminated during the punching operation. When punching holes manually, the 6-hole pattern has a clear advantage: the reduction in the number of holes punched allows one to nearly double the number of sheets to be punched without exerting more manual effort. This is true because the amount of manual effort required is based on the total number of holes to be punched. Another benefit of the invention is that fewer fingers in a binding requires less plastic and ultimately results in a lower cost to the end user.

From the following, it will become even more evident that I have invented a binding compatible with GBC and Velo-bind binding systems and can be adapted to other systems which use binding components that interact with punched or drilled holes in paper sheets intended for binding into books or the like.

In accordance with my invention, two different binding strip elements are used. For convenience in describing the relative orientation of the components of the invention, I refer to one as top and the other as bottom, although in use it makes no difference which is which. The bottom binding strip contains preferably six fingers spaced so that each finger enters its assigned hole in a stack of paper sheets. Holes in the top binding strip are dimensioned to receive the fingers of the bottom binding strip. The thickness of each finger is less than a third of the long edge dimension of the hole it enters. No matter how many fingers are used, no less than two should enter opposite ends of different holes. Thus, all sheets are trapped and aligned with each other.

While it is possible to use an even or odd number of fingers in numerous configurations with the number of fingers ranging from 2 to 19, I have determined that the best number of fingers and their arrangement for a binding capable of holding 2 to 200 sheets of paper with high security and lowest cost is six fingers paired. Thus, for 8½" × 11" paper I use three pairs of fingers with equal spacing between the fingers of each pair and different but equal spacing between pair one and two, and two and three. Thus, if I use GBC's 19 hole configuration and number each hole from 1 to 19 from left to right, I can define the preferred location of my three pairs of fingers by referring to FIG. 1B. Pair one utilizes holes 1 and 5, pair two uses 8 and 12, and the third pair uses holes 15 and 19.

After insertion of the fingers through the sheets and the top binding strip, the fingers of each pair of fingers are bent towards each other around cross-piece-like protrusions in the top binding. This produces a clamping effect upon the top binding and traps the sheets between the bindings.

The angle of bend of the finger, as measured between the portion of the finger protruding through the sheets and the portion of the finger which is bent over is no more than 90°, preferably is less than 90°, and most preferably is 80°-85°.

As the fingers within each pair are deflected towards each other, protrusions on the edges of the fingers engage wedge-like protrusions within elongated holes in the top binding and the fingers become locked in place.

Even if maximum security is sought to discourage unauthorized unbinding of books bound with the binding, it is usually not necessary with the invention to heat-weld or cement portions of the fingers of one binding strip to portions of the second, mating binding strip.

Other aspects and features of the invention will be more fully apparent from the following disclosure and appended claims.

DETAILED DESCRIPTION OF THE INVENTION AND PREFERRED EMBODIMENTS THEREOF

Figure 1:
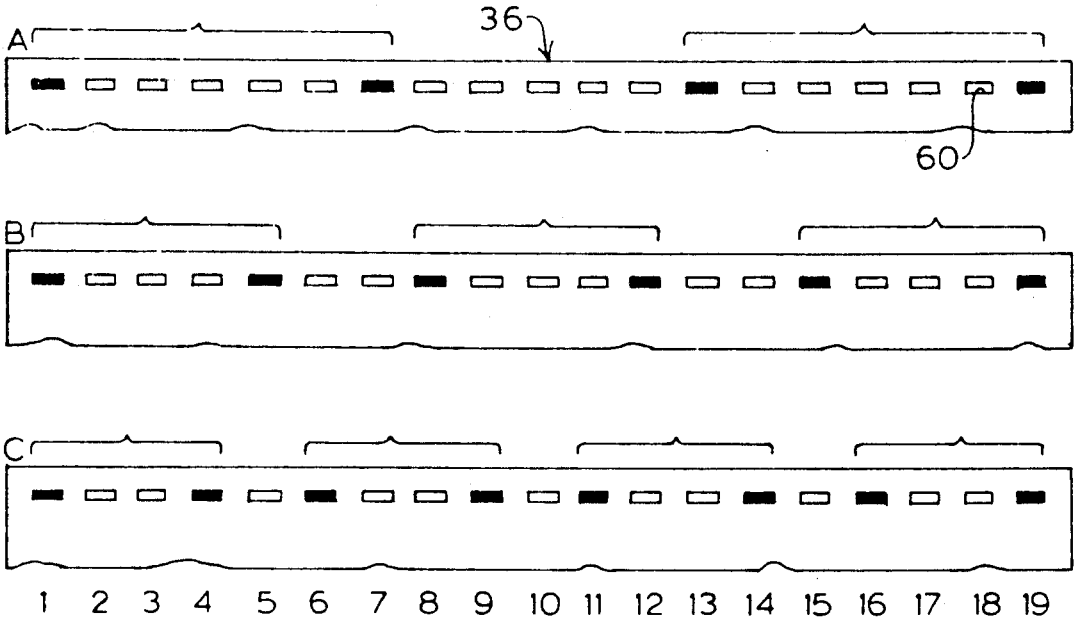
FIG. 1 (A-C) is a schematic drawing of three possible binding arrangements using the invention with standard 19-punch sheets using 4, 6, and 8 holes respectively. In the figure, the holes to be used are blackened and the pairing of holes is indicated by brackets extending between the holes of each pair.

The present invention provides a binding, preferably of molded plastic, as shown in FIGS. 2-14. The binding of the invention comprises:

(a) a first binding strip 20 having one or more pairs of bendable fingers 22, each of said fingers 22 having a pair of linearly extending protrusions 24 oppositely positioned on the sides of said fingers 22 and extending along said fingers 22; and (b) a second binding strip 26 having one or more pairs of holes 28 extending through the second binding strip 26, and alignable with said pairs of fingers 22; said second binding strip 26 further comprising cross-pieces 30 adjacent each hole 28 and located between the holes 28 of each pair of holes 28; said second binding strip 2 having elongated holes 32 extending between said cross-pieces 30 of each pair of holes 28, said elongated holes 32 having a protruding wedge 34 (or 34A) on each side 68 of each elongated hole 32; wherein when said fingers 22 are placed through the holes 28, said fingers 22 may be locked on to the second binding strip 26 by bending each of the fingers 22 of each pair toward the other finger 22 of said pair over the nearest cross-piece 30 and into the elongated hole 32 adjacent the cross-piece 30 so that the linear protrusions 24 are locked in the elongated hole 32 by the protruding wedges 34 (or 34A).

Figure 2:
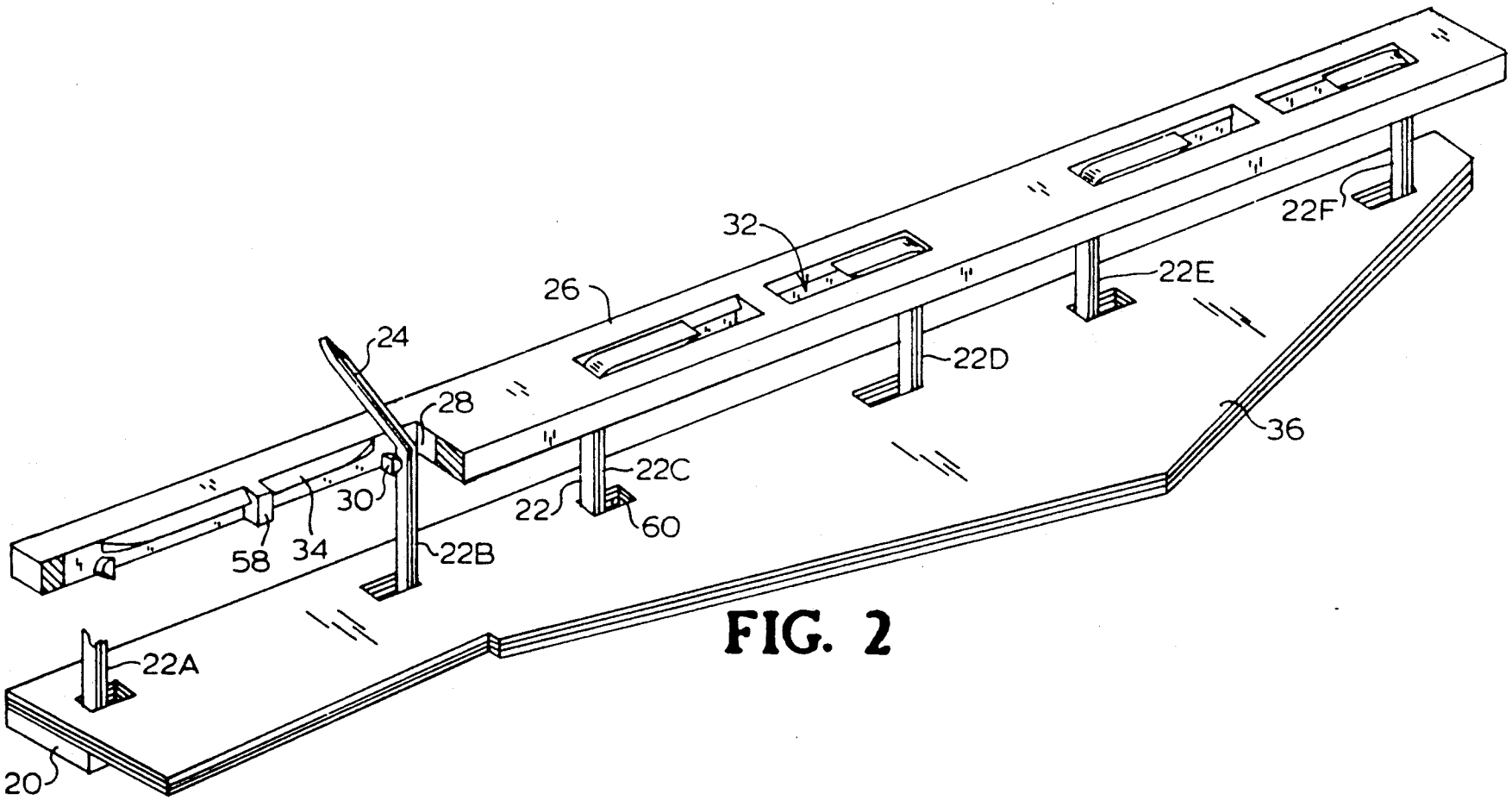
FIG. 2 is a perspective view of portions of top and bottom binding strips engaged with paper sheets and each other but pulled apart to show the connection. The clamp and locking mechanism is also shown.

The fingers 22 on first binding strip 20 are preferably arranged in three pairs aligned as shown in FIG. 2 to match with apertures 60 in a standard 19-punch GBC sheet (FIG. 1B). Alternatively, two or four pairs of fingers 22 may be used for the same paper, located to match apertures 60 as shown in FIG. 1A and 1C.

In FIG. 2, first (bottom) binding strip 20 is shown engaged at the bottom of a stack 36 of sheets, for example, of paper, with each of three pairs of fingers 22A and B, 22C and D, and 22E and F, located at positions 1 and 5, 8 and 12, 15 and 19 respectively thrust through six, co-aligned apertures 60 in sheets 36 and joined to second (top) binding strip 26. The left portion of binding strip 26 is partially cut away to show cross-pieces 30 and protruding wedges 34, 34A.

Figure 4:
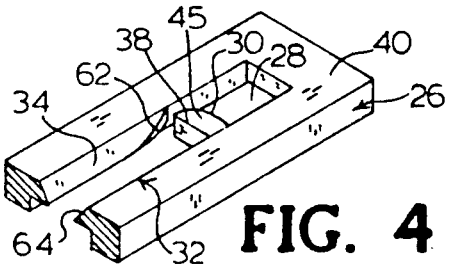
FIG. 4 is a sectional perspective view of a cross-piece and elongated hole showing the tapered edges of the wedges near the cross-piece.
Figure 3:
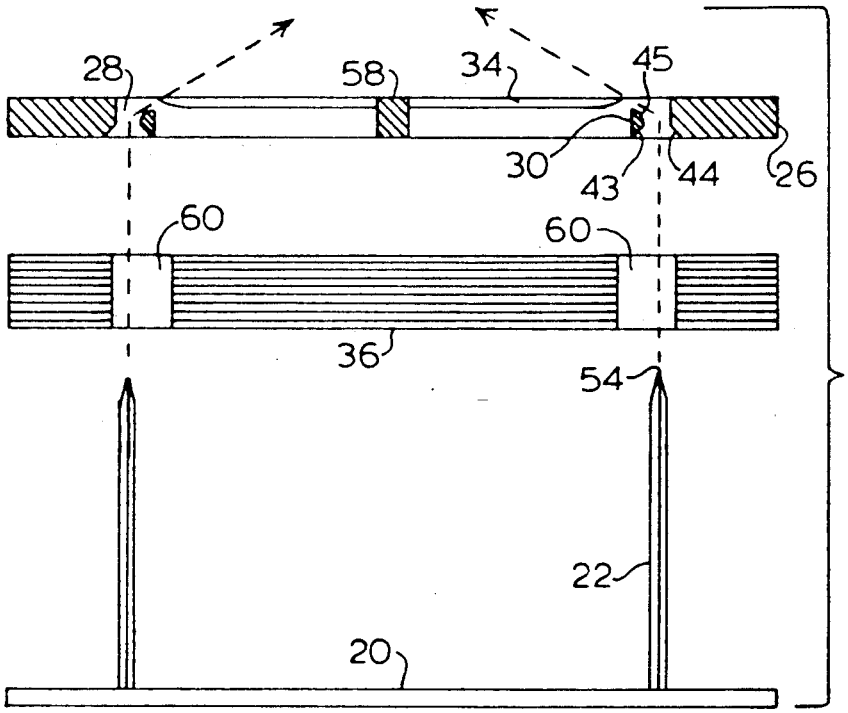
FIG. 3 is a side elevational exploded view of the method of assembling top and bottom binding strips and traces their assembly paths through the holes in a stack of paper sheets.
Figure 5:
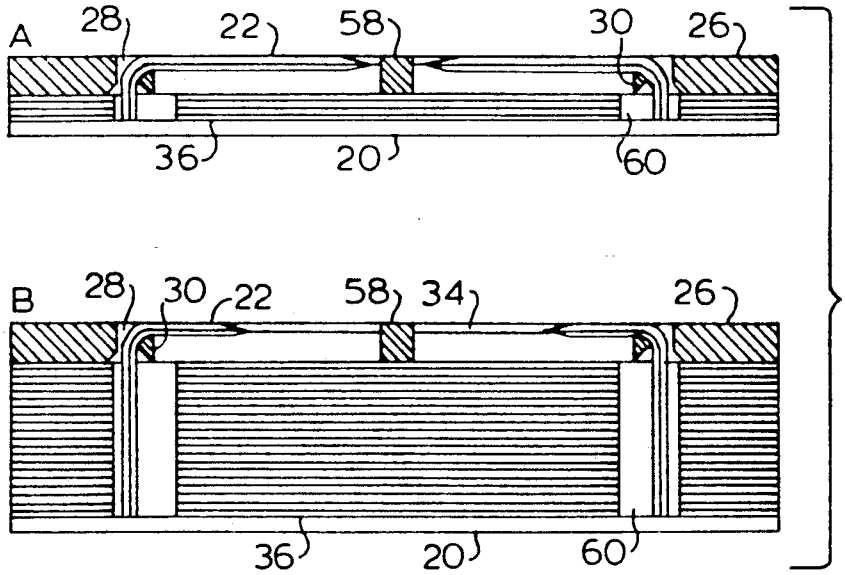
FIG. 5 is a cross-section showing the means of binding with as few as 2 (FIG. 5A) and over 200 sheets (FIG. 5B) of standard, 20 lb., paper with top and bottom binding strips.

As shown in FIGS. 3-5, top 38 of cross-piece 30 is preferably lower than the upper surface 40 of second binding strip 26 so that when finger 22 is bent over it, the outer, upper surface 42 of finger 22 does not protrude upward to a great extent. Cross-pieces 30 preferably have an angled lower surface 43 so that fingers 22 are guided into holes 28. The opposing side 44 of hole 28 on the main portion of binding strip 26 is also preferably angled. Cross-pieces 30 preferably also have rounded upper surfaces 45 over which the fingers 22 bend smoothly (FIG. 4). This reduces the possibility of notching and weakening finger 22 as it folds over cross-piece 30. When finger 22 is brought over cross-piece 30 and down into elongated hole 32, the cross-piece of second binding strip 26 is forced downward onto sheets 36 to provide a firmer clamping action on the bound sheets.

Figure 6:
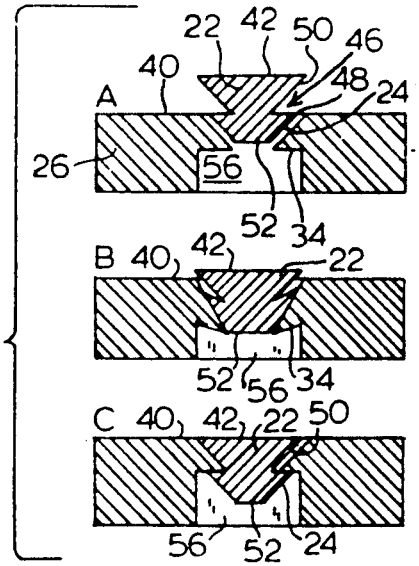
FIG. 6 (A-C) is a series of cross-sections showing the sequence of interaction between a finger and the top binding as the two components meet during the locking sequence.
Figure 8:
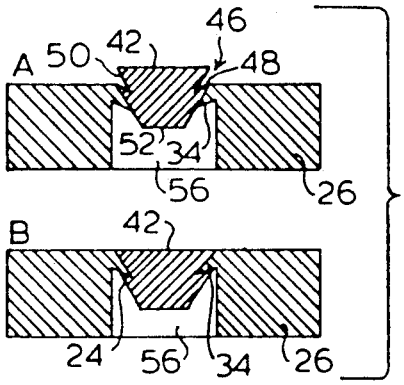
FIG. 8 (A-B) is a series of cross-sections of the most preferred finger and top binding showing the finger prior to (8A) and after (8B) inserting in the binding.

Each finger 22 preferably has a cross-section shaped as shown in FIGS. 6 and 8 in which an outermost side 42 of finger 22 (in the paired set of fingers) is flat. This side 42 becomes the top side when finger 22 is placed in elongated holes 32. Extending along the side of each finger 22 is an indentation 46 and then a protrusion 24 extending lengthwise along finger 22.

The side 48 of protrusion 24 closest to outermost side 42 (which is the lower side of the indentation 46) forms an acutely angled indentation 46, between side 48 and side 50 of the indentation 46 which may be an angle as shown in FIG. 6A and 8A. Most preferably the acute angle between side 48 and side 50 is even more acute than the embodiment shown in FIG. 6A and has a cross-section as shown in FIG. 8A. The side of each finger 22 then angles down to a generally flat innermost side 52 of the finger 22. When inserted in the elongated hole 32, the preferred finger 22, as shown in FIG. 8B, is even more firmly locked in angled wedge 34A than the finger 22 shown in FIG. 6, so that it is essentially permanently locked and cannot be pulled out of the elongated hole 32 without great difficulty.

Fingers 22 preferably have pointed tips 54 (FIG. 3) for easier insertion into holes 28. Fingers 22 also preferably are molded to have a light texture (not shown) on the flat innermost side 52 of each finger 22 (FIG. 6), as is the rounded side 44 of each cross-piece 30 where fingers 22 bend over them. The friction between cross-pieces 30 and fingers 22 increases the holding power of the clamping mechanism of the invention.

Elongated holes 32 (FIGS. 2 and 4) extend completely through second binding strip 26. In addition to providing a better lock, these holes 32 are easier to mold into the binding strip than depressions would be.

Figure 7:
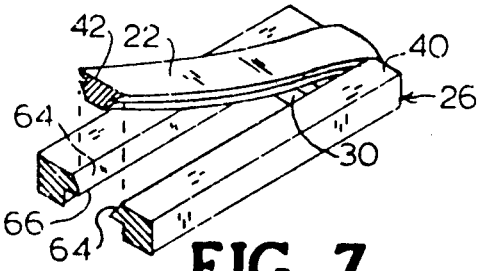
FIG. 7 is a perspective view illustrating how the fingers of the bottom binding mesh with the top binding just before final locking.

Wedges 34 (or 34A) appear on both sides 68 of the elongated holes 32 which receive locking fingers 22 and appear enlarged in FIGS. 6-8. The wedges 34 (or 34A) may extend along the sides 68 of the elongated holes 32 parallel to the paper or other material being bound as shown in FIG. 1, but preferably the wedges are angled as shown as wedge 34A in the embodiments of FIGS. 9-14 so that they extend downward away from the cross-piece 30. These figures show two alternate ways in which the angled wedge 34A may be configured.

Figure 9:
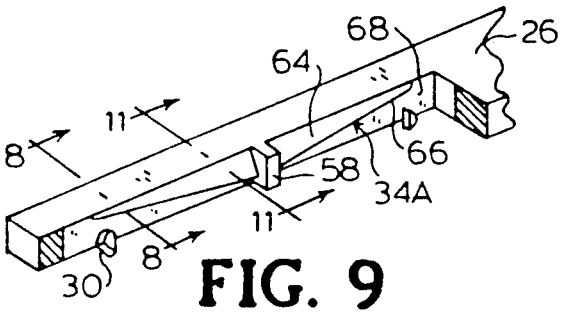
FIG. 9 is a perspective view illustrating one embodiment of the preferred angled wedge of the invention.
Figure 10:
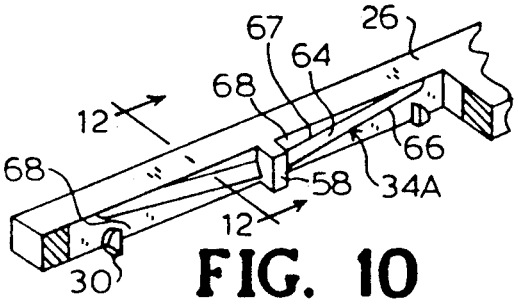
FIG. 10 is a perspective view illustrating a second embodiment of the preferred angled wedge of the invention.
Figure 11:
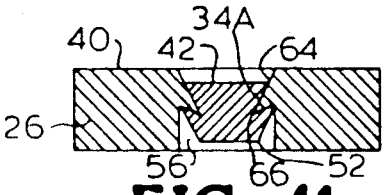
FIG. 11 is a cross-sectional view of the preferred angled wedge of FIG. 9 at a point close to the end of the elongated hole away from the cross-piece.
Figure 12:
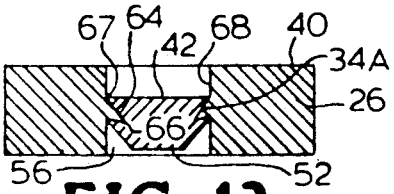
FIG. 12 is a cross-sectional view of the preferred angled wedge of FIG. 10 at a point close to the end of the elongated hole away from the cross-piece.
Figure 13:
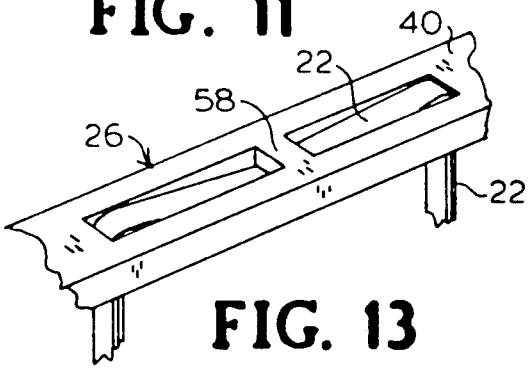
FIG. 13 is a perspective top view of two fingers inserted in two elongated holes of the binder of the embodiment shown in FIG. 9 of the invention.
Figure 14:
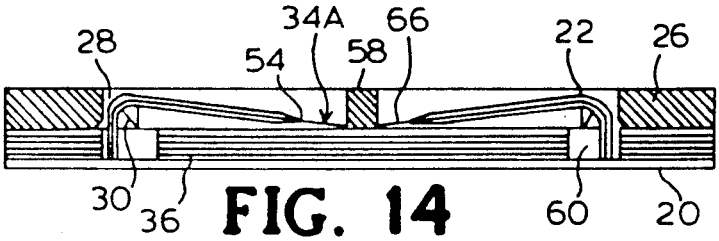
FIG. 14 is a cross-sectional view of two binding fingers according to the embodiment shown in FIG. 9.

In the embodiment shown in FIGS. 9 and 11, the top surface 64 of the angled wedge 34A gets wider as the wedge edge 66 extends downward and away from the cross-piece 30. In the embodiment shown in FIGS. 10 and 12, the top surface 64 of the angled wedge 34A remains the same width with the wedge edge 66 running parallel to the junction 67 of the angled wedge 34A with the elongated hole side 68. FIGS. 13 and 14 show the position of the fingers 22 when locked in place by the downwardly angled wedge 34A.

In the preferred embodiments having an angled wedge 34A, when a finger 22 is bent over a cross-piece 30 with its protrusions 24 latched under the angled wedges 34A, the end of the finger 22 is lower than the portion of the finger 22 which is bent over the cross-piece 30 so that the finger 22 extends downward at an angle. Thus, in the preferred embodiment the overall angle made by the finger 22 with respect to the sheets being bound is less than 90°, and is preferably 80°-85°.

FIG. 3 shows another view of the assembled components described above and shows how fingers 22A and 22B of binding strip 20 thrust through holes 28 of the top binding strip 26 and pass pivot cross-pieces 30. When fingers 22A and 22B are rotated inwardly toward each other and over cross-pieces 30, fingers 22A and 22B engage protruding wedges 34 (or 34A) of FIG. 2 within elongated holes 32 of binding strip 26 as shown in FIGS. 2 and 6-8.

The top side 64 of each wedge 34 (and 34A) which is first encountered by an inserted finger 22 is preferably smooth to make the insertion process easier. When viewed from the top (FIG. 4) the edges 66 of the wedges 34 are generally parallel to each other for the majority of the finger-holding region of the elongated hole 32, but near where fingers 22 encounter wedge 34 after being bent over cross-piece 30, the wedges 34 have a slightly tapered area 62 so that the process of placing a finger 22 in an elongated hole 32 is a smooth, generally continuous process. This tapered area 62 is also preferably present with angled wedges 34A.

To bind the book, the end of each finger 22 is bent downward toward nearby elongated hole 32. As flat inner side 52 of finger 22 is lowered into elongated hole 32, protrusion 24 is bent upwards toward indentation 46 (FIG. 6B) and wedges 34 (or 34A) are bent downward. With increased pressure, protrusions 24 snap into locking space 56 below wedges 34 (or 34A) and are firmly held by the wedges 34, 34A (FIG. 6C).

Preferably, between the elongated holes 32 of each pair of elongated holes 32 is a cross-portion 58 (FIG. 2) which helps to strengthen second binding strip 26, by bracing the sides of the strip together and eliminating the long continuous hole. For bindings where more fingers 22 are used, such as eight, especially where fewer pages are to be bound, cross-portion 58 may be omitted between shorter elongated holes 32.

Certain design parameters are important. For example, the distance between fingers 22A and 22B should be maximized so that for the length of the fingers 22 the maximum number of sheets is achieved, without causing fingers 22 to overlap in binding strip when only a few sheets are bound, as shown in FIG. 5A. However, the length of finger 22 protruding above upper binding strip 26 must be sufficient to lock fingers 22A and 22B to top binding strip 26. The comments about fingers 22A and 22 also applies to the remaining pairs of fingers (22C and 22D; and 22E and 22F). Also note that when binding the minimum number of sheets, there must be enough room to store the fingers 22 in elongated hole 32 as shown in FIG. 5B.

Binding strips 20 and 26 and fingers 22 are preferably molded of any bendable, non-brittle substance which is not prone to fracturing. Preferable materials include plastics such as polypropylene. Preferably binding strips 20 and 26 are about $\frac{1}{4}$" to $\frac{1}{2}$" wide, match the length of the page being bound (e.g., 11"), and are about 0.07" to 0.09" high. Preferably fingers 22 have the dimensions of about $1\frac{1}{8}$ inches long, with a cross-sectional dimension of about $\frac{1}{8}$" to $\frac{1}{4}$" (or less) by about slightly less than the narrowest dimension of the apertures 60. These dimensions allow fingers 22 to be easily bent due to their thinness.

The distance between the outside of hole 28 into which finger 22 is inserted (the outside being the farthest side from the associated cross-piece 30) and the farthest end of the associated elongated hole 32 is about $1\frac{3}{8}$ inches, when the binding is used for standard $8\frac{1}{2}$"×11" books with a thickness of 2-200 pages and the binding has three pairs of fingers 22 (each page being about 0.0035" thick). For use in binding very thick volumes, the fingers 22 may be lengthened appropriately. Such longer fingers 22 may be marked to be cut off for various thicknesses of thinner volumes to avoid having the ends of the fingers 22 extend beyond the inner end of the elongated holes 32 when the book is bound. Adjustments in size may be made for different size books, different thickness of books, and different weights of bound sheets. Preferably the two binding strips 20 and 26 are wide enough to hide all apertures 60 of the stacked sheets even if not used by the particular binding strip.

The number of holes 28 punched, the spacing of the holes 28 and the number of fingers 22 used also may be adjusted for functional or aesthetic reasons without departing from the scope of the invention herein. Generally, the apertures 60 are elongated and extend lengthwise along the side of the paper. Preferably, fingers 22 within pairs are spaced so that they enter near the extreme outside ends of apertures 60 in a pair so that shifting of the pages is minimized. The above discussion of the invention relates to standard size pages used in the United States. Adjustments in the number of holes 28 and fingers 22 may be easily made for different sizes of sheets.

The invention may be employed wherever a multiplicity of apertures 60 is used to bind a sheet of paper, plastic or other material of any size. The shape of the holes 28 may also vary from rectangular to round, oval, decorative or square, for example, without affecting the function of the invention. The size and location of the holes 28 and the cross-sectional area of the fingers 22, must be such as to allow the fingers 22 to be placed through the holes 28, and the paper to be held firmly without sliding in a manner that would make the binding undesirable.

In the invention, particularly in the preferred embodiment, once the fingers 22 are latched under the wedges 34, 34A the binding is secure and very difficult to undo accidentally or on purpose. The cross-sectional shape of the fingers 22 and the angled wedges 34A providing the means of interlocking, plus the feature of bending the fingers 22 over cross-pieces 30 and extending them down at an angle and into the elongated holes 32 provides a secure binding in a manner not previously known in the art.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A securely bound book comprising:

(a) plurality of sheets each formed with a plurality of apertures adjacent a first margin;

(b) a first binding strip on one side of said book;

(c) a second binding strip on the other side of said book opposite of and aligned with said first binding strip, said second binding strip having one or more pairs of holes aligned with apertures in the sheets, wherein between the holes of each pair and adjacent each hole is a cross-piece, wherein said second binding strip has two elongated holes extending between said cross-pieces and parallel to the first margin; wherein said first binding member includes one or more pairs of fingers aligned with and extending through said apertures and through said pairs of holes, each of said fingers being bent at an angle of about 80°-90° over a cross-piece and into an elongated hole; wherein each elongated hole has protruding wedges extending linearly along each long edge of the hole; and wherein each of said fingers has a protrusion extending lengthwise along each side of said finger, said protrusions being shaped so that they are locked beneath said wedges.

2. A bound book according to claim 1, wherein the wedges are angled downward away from the cross-piece and the fingers extend at a downward angle from the cross-pieces.

3. A bound book according to claim 1, wherein there are six fingers on said first binding strip.

4. A bound book according to claim 1, wherein the surface of each finger which is bent over a cross-piece and the surface of the cross-piece over which the finger is bent are each rough in texture.

5. A bound book according to claim 1, wherein the surface of the cross-piece over which the finger is bent is rounded.

6. A bound book according to claim 1, wherein the fingers have pointed ends.

7. A bound book according to claim 1, wherein there are six fingers inserted through the apertures numbered 1, 5, 8, 12, 15 and 19 if the apertures are numbered sequentially beginning at one side of the sheets.

8. A bound book according to claim 1, wherein there are four fingers inserted through the apertures numbered 1, 7, 13, and 19 if the apertures are numbered sequentially beginning at one side of the sheets.

9. A bound book according to claim 1, wherein there are eight fingers inserted through the apertures numbered 1, 4, 6, 9, 14, 16, and 19 if the apertures are numbered sequentially beginning at one side of the sheets.

10. A binder for a plurality of sheets, each of said sheets formed with a plurality of apertures adjacent a first margin, comprising:

(a) a first binding strip having one or more pairs of bendable fingers, each of said fingers having a pair of linearly extending protrusions oppositely positioned on the sides of said fingers and extending along said fingers;

(b) a second binding strip having one or more pairs of holes extending through the second binding strip and alignable with the apertures in the sheets and with the fingers, wherein between the holes of each pair and adjacent each hole is a cross-piece, said second binding strip having two elongated holes extending between said cross-pieces and being parallel to the first margin; wherein each elongated hole has protruding wedges extending linearly along each long edge of the hole; wherein each of said fingers is bendable at an angle of about 80°-90° over a cross-piece and into an elongated hole; and wherein said protrusions on said fingers are shaped so that they are lockable beneath said wedges in a plurality of positions.

11. A binder according to claim 10, wherein the wedges are angled downward from the cross-piece.

12. A binder according to claim 10, wherein there are six fingers on said first binding strip.

13. A binder according to claim 10, wherein the surface of each finger which is bent over a cross-piece and the surface of the cross-piece over which the finger is bent are each rough in texture.

14. A binder according to claim 10, wherein the surface of the cross-piece over which the finger is bent is rounded.

15. A binder according to claim 10, wherein the fingers have pointed ends.

16. A binder according to claim 10, wherein there are six fingers inserted through the apertures numbered 1, 5, 8, 12, 15 and 19 if the apertures are numbered sequentially beginning at one side of the sheets.

17. A binder according to claim 10, wherein there are four fingers inserted through the apertures numbered 1, 7, 13, and 19 if the apertures are numbered sequentially beginning at one side of the sheets.

18. A binder according to claim 10, wherein there are eight fingers inserted through the apertures numbered 1, 4, 6, 9, 14, 16, and 19 if the apertures are numbered sequentially beginning at one side of the sheets.

19. A method of binding a plurality of sheets securely together, comprising:

(a) providing a plurality of sheets, each formed with a plurality of apertures adjacent a first margin;

(b) inserting a plurality of fingers of a first binding strip through all apertures which are aligned with said fingers;

(c) inserting the fingers through holes in a second binding strip;

(d) bending the fingers over a cross-piece on the second binding strip at approximately a right angle; and (e) locking linearly extending protrusions on each side of said fingers beneath protruding wedges extending along the sides of elongated holes in the second binding strip.

20. A method according to claim 19, wherein the wedges are angled downward from the cross-piece.

21. A securely bound book comprising:

(a) a plurality of sheets each formed with a plurality of apertures adjacent a first margin, said apertures being on 0.5625 inch centers;

(b) a first binding strip on one side of said book;

(c) a second binding strip on the other side of said book opposite of and aligned with said first binding strip, said second binding strip having one or more pairs of holes aligned with apertures in the sheets, wherein between the holes of each pair and adjacent each hole is a cross-piece, wherein said second binding strip has two elongated holes extending between said cross-pieces and parallel to the first margin; wherein said first binding member includes one or more pairs of fingers aligned with and extending through said apertures and through said pairs of holes, each of said fingers being bent at an angle of about 80°-90° over a cross-piece and into an elongated hole; wherein each elongated hole has protruding wedges extending linearly along each long edge of the hole; and wherein each of said fingers has a protrusion extending lengthwise along each side of said finger, said protrusions being shaped s that they are locked beneath said wedges.

* * * * *